US007046947B1

(12) United States Patent
Castelli et al.

(10) Patent No.: US 7,046,947 B1
(45) Date of Patent: May 16, 2006

(54) FREE SHEET COLOR DIGITAL OUTPUT TERMINAL ARCHITECTURES

(75) Inventors: Vittorio Castelli, Yorktown Heights, NY (US); Joannes N M Dejong, Hopewell Junction, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/010,544

(22) Filed: Dec. 13, 2004

(51) Int. Cl.
*G03G 15/24* (2006.01)
*G03G 15/20* (2006.01)

(52) U.S. Cl. ..... 399/307; 399/301; 399/299; 399/40

(58) Field of Classification Search ..... 399/307, 399/301, 299, 39, 40
See application file for complete search history.

(56) References Cited

U.S. PATENT DOCUMENTS 4,504,138 A 3/1985 Kuehnle et al.
4,531,828 A * 7/1985 Hoshino ..... 347/118
5,436,706 A 7/1995 Landa et al.
5,499,093 A 3/1996 Aerens et al.
5,598,396 A 1/1997 Horibe et al.
5,610,694 A 3/1997 Lior et al.
5,619,313 A 4/1997 Domoto et al.
5,708,950 A 1/1998 Badesha et al.
6,059,284 A * 5/2000 Wolf et al. ..... 271/227
6,128,465 A * 10/2000 Castelli ..... 399/381
6,289,191 B1 9/2001 Liu et al.
6,456,310 B1 * 9/2002 Wallace et al. ..... 347/116
6,920,304 B1 * 7/2005 Kanesawa et al. ..... 399/328

* cited by examiner

*Primary Examiner*—Arthur T. Grimley
*Assistant Examiner*—Joseph S. Wong
(74) *Attorney, Agent, or Firm*—William A. Henry, II

(57) ABSTRACT

A free sheet, high speed, color tandem printing system that controls registration of images from one imager to another while mechanically decoupling individual imagers and all the while maintaining relative registration of each of the color separations by the use of spherical transport servo devices or spherical nips (SNIPS). SNIPS correct skew, lateral, and process positions and ensure proper registration of a sheet with a station.

10 Claims, 5 Drawing Sheets

FREE SHEET COLOR DIGITAL OUTPUT TERMINAL ARCHITECTURES

This disclosure relates to paper transport mechanisms in color electrostatogaphic, electrophotographic and xerographic printing and reproduction machines, and more particularly, to precisely registering free sheets therein.

Prior art media transport systems use mechanically coupled devices, such as mechanically coupled cylindrical rollers, to move a sheet of paper or other print media from one station to the next in a xerographic printing machine. A disadvantage of such mechanical coupling is that interactions can arise between stations. This can lead to paper jams, misfeeds, crumpling, and other detrimental results. Moreover, machines of this type have a fixed pitch between media sheets, so that they suffer from greatly decreased productivity when short media sheets are used.

Various designs of color printers and copiers have been advanced in the past. One type of copier utilizes single engine architecture, requiring the multi-pass transfer of three primary color images onto a copy sheet. However, there is a severe drawback to the throughput limitations of single engine color copiers.

For higher productivity, multiple engines in tandem types of architectures have been proposed. One common approach utilizes an intermediate transfer belt to accumulate sequentially all of the primary images, and then the composite image is transferred to copy paper in a singe pass.

Another approach utilizes a paper escort mechanism to bring the paper into contact with the different color engines for image transfer to take place. Examples of this utilize a chain gripper or a large drum with a mesh screen. For example, U.S. Pat. No. 4,531,828 to Hoshino discloses a color printer having tandem engine architecture. The color printer comprises four sets of laser beam printer mechanisms, an insulative screen belt formed of meshes of fibers and driven by a pair of belt driving rollers, a paper supply mechanism and a fixing device. This design utilizes a belt to engage and drive a sheet through the printer to provide multicolor images thereon. This design has inherent problems with registration and its attempts to remedy this problem by designing lengths between individual engines to equal a circumference of a drive roll.

Additionally, U.S. Pat. No. 5,499,093 discloses an electrostatographic single-pass multiple station color printer for forming an image onto a web that has a plurality of toner image-printing eletrostatographic stations. Each station has a drum onto the surface of which a toner image can be formed. An exposure station forms an electrostatic image line-wise on each drum surface. This image is toned and a corona device transfers the toner image onto the web, which is conveyed in succession past the station in synchronism with the rotation of the drum surface. A register control apparatus is provided for controlling the operation of each of the stations in timed relationship thereby to obtain correct relative registering of the distinct toner images on the web. The register control apparatus comprises an encoder driven by the displacement of the web to produce pulses indicative of web displacement, and a delay arranged to initiate the operation of subsequent stations after a predetermined web displacement, as measured by the encoder, has occurred.

An imaging system is disclosed in U.S. Pat. No. 6,289,191 B1 for effecting single pass, multi-color printing of a color image. The imaging system includes a plurality of contact electrostatic printing engines operable in serial fashion upon a copy substrate. Each contact electrostatic printing engine images and develops a respective electrostatic latent image representative of a component of the color image, and subsequently transfers the developed component image to the copy substrate as the copy substrate proceeds in a single pass through the imaging system.

A color printing machine which incorporates a transfusing station having a transfusing member with a resistive heater layer, a substrate, and release layer is shown in U.S. Pat. No. 5,708,950. The transfusing station is entrained between at least two electrically conductive contact members, such as rollers, which electrically contact the heater layer. An electrical source sends current through the conductive rollers and the heater layer, heating the layer, the substrate, the release layer, and any toner on the release layer. A backup roller adjacent the transfusing member and the conductive rollers induces pressure on marking substrates which pass between the backup roller and the transfusing member. The combination of heat from the heater layer and pressure induced by the backup roller causes any toner image on the transfusing member to fuse onto the marking substrate. The release layer assists in transferring the toner onto the marking substrate.

There are numerous problems associated with known color printers. Multiple pass color printers have reduced throughput and additionally require multiple actions of advancing a transfer material, transferring an image portion corresponding to a particular primary color, and then returning the transfer material to the starting location. This requires complex tracking, sensing and control to ensure quality image registration when the images are superimposed. Transient errors due to drives and roller components starting, stopping and accelerating are commonplace and hard to overcome without sophisticated, high-cost hardware to minimize or take account for these errors.

Single pass color printers had only moderate throughput and usually have complex control and sensing requirements to ensure proper registration. This is due to the large number of interrelated components and many sources for registration and timing errors. This is primarily brought about due to positional errors between print engines, intermediate rollers and the image-receiving sheet. Slippage may occur continually or intermittently between these interrelated components, causing registration errors. Additionally, multiple sensors and other hardware must control the relative velocities and accelerations of the components to ensure proper registration.

Obviously, there is still a need for a color printer that registers images more precisely, that obviates interactions between stations, and enable greater flexibility in productivity and machine configurations.

Accordingly, free-sheet color digital output terminal architectures are disclosed that control registration of images from one imager to another while mechanically decoupling individual imagers and all the while maintaining registration of images by the use of spherical transport servo devices or spherical nips (SNIPS). SNIPS correct skew and ensure proper registration of a sheet with a station. For example, as a sheet enters a SNIPS pair, the servo uses information from one or more sensors control the sheet's position and angle so that the sheet's leading edge will engage a transfix nip at a precise time and with reasonable match to the velocity of an image carrying belt. Embodiments use analog edge sensors positioned along the sheet's edge and a predetermined distance apart to measure sheet lateral and angle position. The control strategy uses the sheet lateral and angle measurement to control the SNIPS and position the sheet laterally and in angle to a prescribed value to ensure proper transfer to the next station.

The foregoing and other features of the disclosure will be apparent and easily understood from a further reading of the specification, claims and by reference to the accompanying drawings in which like reference numerals refer to like elements and wherein:

FIGS. 4 and 4A show a schematic elevation view of a free-sheet version of the tandem electrostatic printing system employing a drum photoreceptor and belt development and a balloon showing marks on the development belt, respectively;

Figure 1:
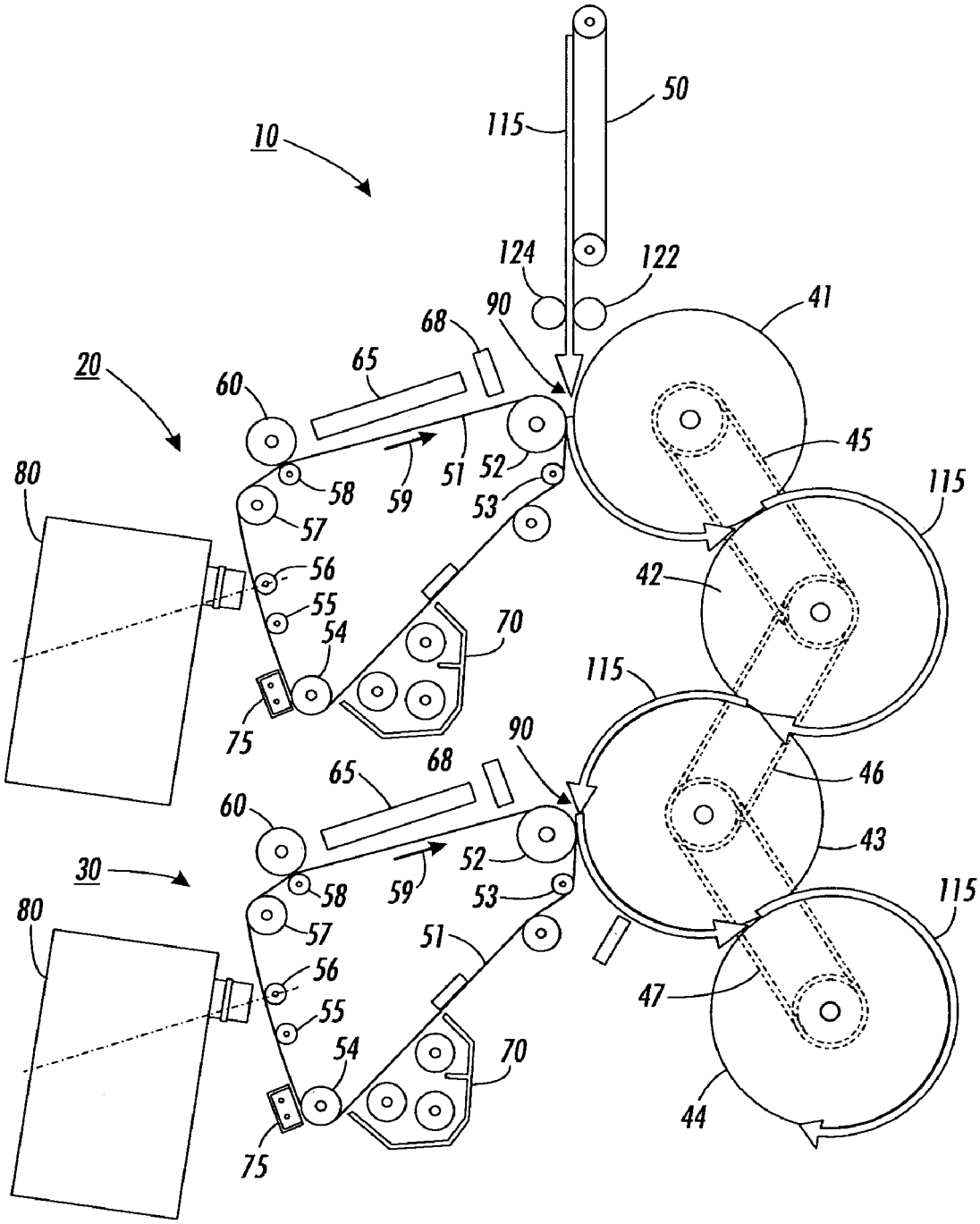
FIG. 1 is a schematic elevation view of a printing press of the escorted sheet type shown in conjunction with a tandem contact electrostatic printing (CEP) system.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to preferred embodiments of a tandem or simultaneous printing system that includes the use of SNIPS for precise sheet registration.

For a general understanding of the features of the disclosure, reference is made to the drawings. In the drawings, like reference numerals have been used throughout to identify identical elements.

A color printing press shown in FIG. 1 as 10, escort sheets 115 from one engine 20 to the next engine 30 by means of precision cylinders 41, 42, 43, and 44. The cylinders in the contact electrostatic printer (CEP) of FIG. 1 are geared together by members 45, 46, and 47 and the sheets are gripped for rotational transport by the cylinders. For the purposes of the present description, the concept of latent image development via direct surface-to-surface transfer of a toner layer via image-wise fields will be identified generally as contact electrostatic printing (CEP). Exemplary patents which may describe certain general aspects of contact electrostatic printing, as well as, specific apparatus therefor, may be found in U.S. Pat. Nos. 4,504,138; 5,436,706; 5,596,396; 5,610,694; and 5,619,313. The fixed dimensions of cylinders 45, 46, and 47 make productivity of the printer optimal for only one predetermined sheet size.

Figure 2:
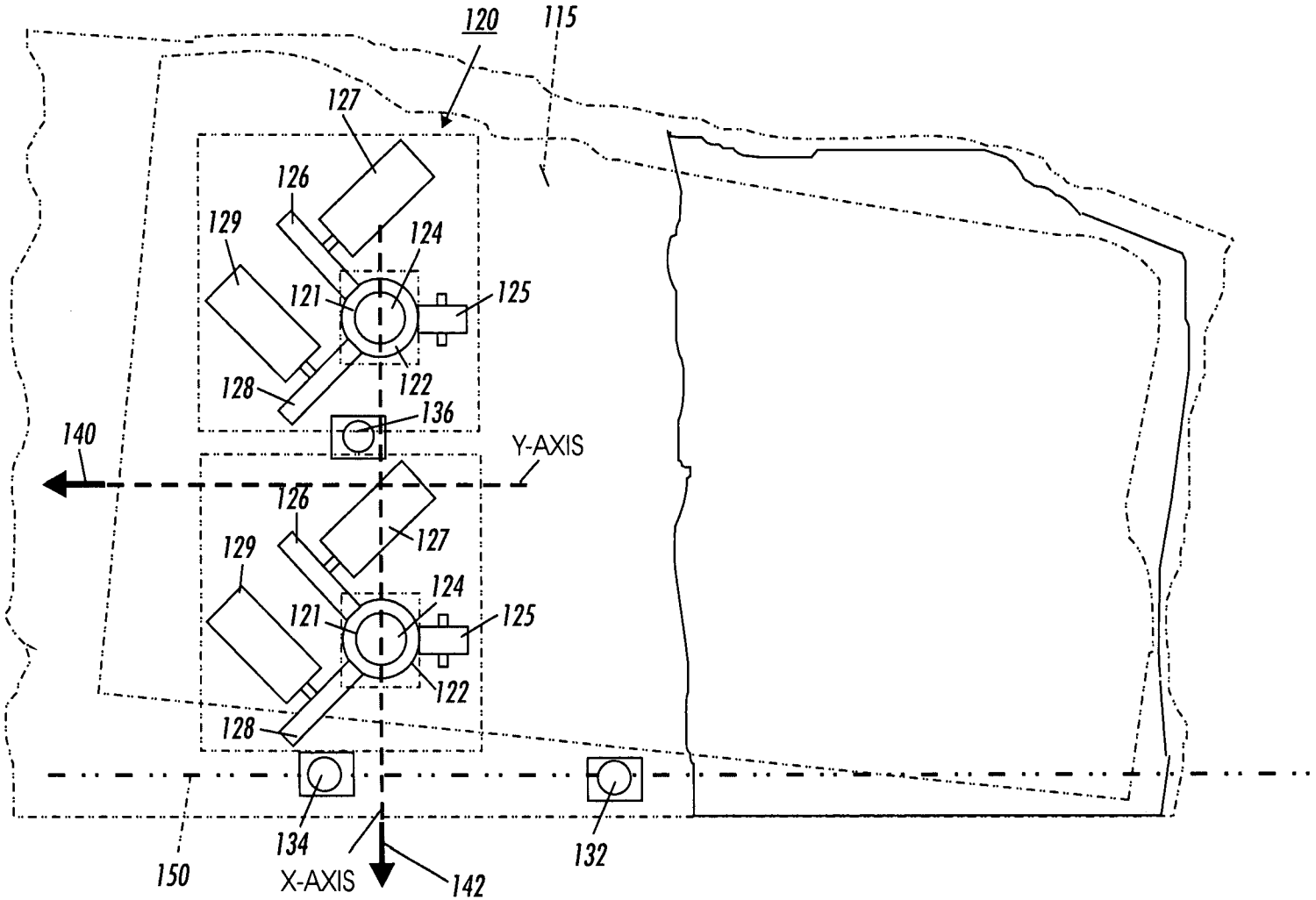
FIG. 2 is a plan view of a SNIPS device that can be used for precise initial registration of sheets as they enter tandem engines, or to reposition the sheets before each printing station.
Figure 3:
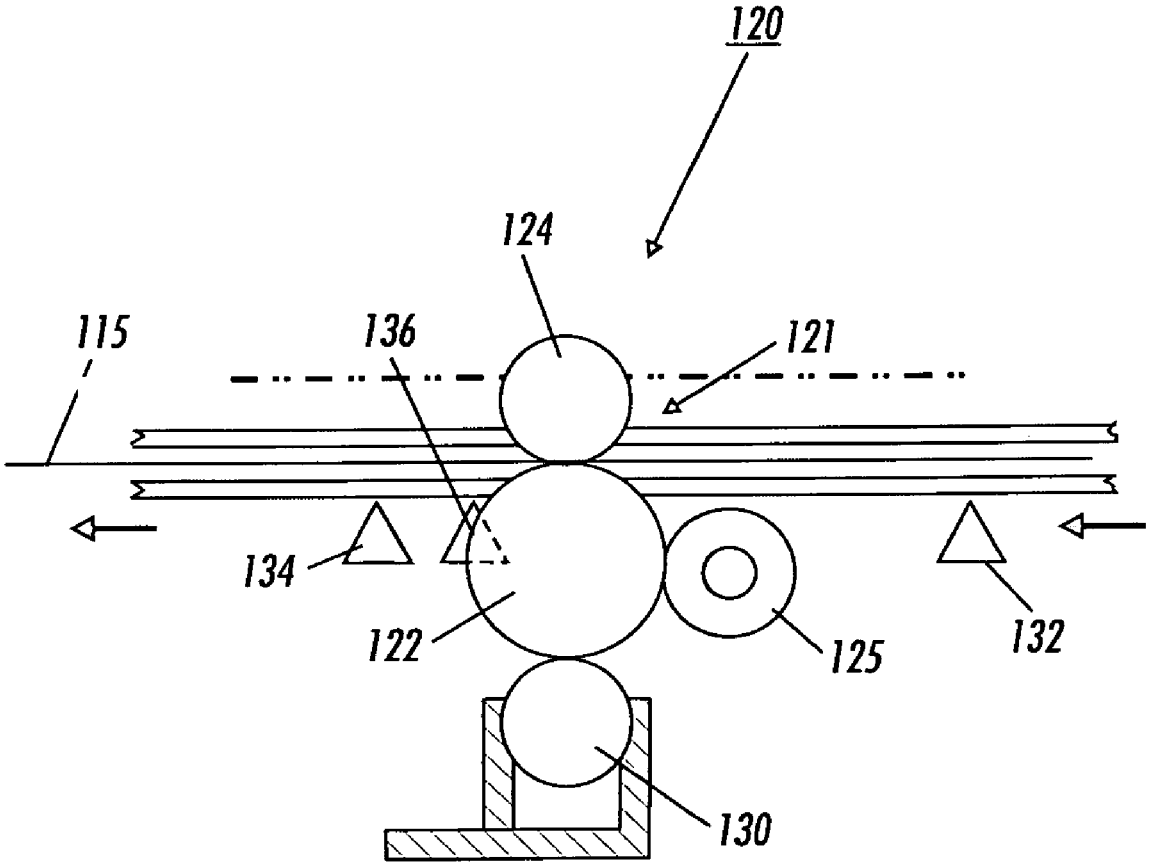
FIG. 3 is a detailed elevational view of the SNIPS sheet registration device of FIG. 2.

Vacuum transport 50 conveys sheets 115 into contact with a registration system that includes one or two servo driven spherical transport device pairs or spherical nips (SNIPS), shown in more detail in FIGS. 2 and 3 and in U.S. Pat. No. 6,059,284, that correct skew and ensure proper registration of the sheets with images on only the first belt 51. One of a series of tandem CEP print engines 20 comprises an image receiving member in the form of a belt 51 that is adapted to rotate in the direction of arrow 59 and is entrained around pressure roll 52, drive rolls 54 and 57, and idler rolls 53, 55, 56 and 58. Belt 51 is charged at 75 and forwarded to an ionographic imager 80 that places an image onto the belt. Continued rotation of the belt drives it past development station 60 where the image on the belt is developed and conditioned at 65. The image on belt 51 then passes two marks-on-belt (MOB) sensors 68 en route to transfix station 90. The sensors 68 measure the time of arrival of sheet 115. When the image enters transfix station 90, pressure roller 52 compresses the image against sheet 115 where it is simultaneously transferred and fused to the sheet. Continued rotation of belt 51 takes it past a cleaning station 70 where the surface of belt 51 is then cleaned of residual developing material and recharged in preparation for the creation of another image. Sheet 115 in the meantime is past consecutively from cylinders 41 to cylinder 42 and then into contact with belt 51 of print engine 30 to receive the part of the same image containing the second color separation in the identical manner. While only two print engines 20 and 30 are shown here, this process is repeated once for each color separation that make up the color image. For example, the charged surface of belt 51 in print engine 20 is imaged at 80, which represents a first color, say cyan. The resultant latent image can be developed with cyan toner particles to produce a cyan image that is subsequently transferred to a marking substrate. The foregoing process is then be repeated for a second color, say magenta with print engine 30, then a third color, say yellow and finally a fourth color, say black. Beneficially, each color toner image is transferred to the marking substrate in superimposed registration so as to produce the desired composite toner image on the marking substrate.

In FIGS. 2 and 3, the SNIPS registration device generally referred to as reference numeral 120, is shown that is suitable for registering the sheet 115 in the process, lateral, and skew directions. A sheet of paper is driven by two independently driven nips 121. Each nip 121 is formed by a drive ball 122 and a backer ball 124. Each drive ball 122 may be caused to rotate about any axis through its center and parallel to the plane of the sheet; the orientation of the axis of rotation depends on the relative speeds of the two drive wheels 126, 128 that drive the ball 122. For example, if drive wheel 126 is kept at zero velocity while drive wheel 128 rotates, the axis or rotation of drive ball 122 will be parallel to the axis of drive wheel 128. Instead, if both wheels 126 and 128 are driven at the same velocity, the axis of rotation of the drive ball will be normal to the process direction as indicated by arrow 142. Thus, the velocity (i.e., magnitude and direction) of the nip may be controlled by controlling the speed of each of the wheels 126, 128 that drive the drive ball 122.

As shown in FIG. 3, in addition to the drive ball 122 and backer ball 124 that form the nip 121, a support ball 130 and support wheel 125 are required to hold the drive ball 122 in position. The support ball 130 and the support wheel 125 are ideally in biased contact with the drive ball 122 so that wear of the components is automatically compensated for as described below.

In operation, it is desired to drive the sheet 115 in the process direction as indicated by arrow 140 while registering its side edge to a reference line 150 passing through edge sensors 132 and 134 (see FIG. 2). There are various control strategies that may be used to do this. One feedback control strategy will now be described. Before the sheet enters the nips 121, both nips are driving in the same process direction 140 at nominal process speed. At that time there is no component of nip velocity in the transverse direction 142. Assume, as a worst case example, that when the sheet 115 enters the nips 121, as sensed by point sensor 136, the sheet does not intersect either of the sensors 132 or 134. In this case the sensors 132, 134 would report an error in the lateral position of the sheet (transverse direction error) and, if the sheet were skewed, the sensors 132, 134 would be unable to detect the skew. At that time the nips 121 would continue driving in the process direction 140 at nominal process speed; in addition, to remove the reported lateral position error, a velocity component in the positive transverse direction 142, proportional to the detected lateral error, would be added. As soon as the sheet intersects both of the sensors 132, 134, the skew error, as well as, a lateral position error, would be detected. At that time, the velocity component in the process direction 140 of each of the nips 121 would be changed. The velocity of one nip would increase and the other would decrease by an amount proportional to the detected skew error. This action would rotate the sheet to remove the detected skew while the lateral error would continue to be removed by the transverse component of the nip velocity.

In this application, the transverse direction 142 (lateral direction) component of the wheel velocity will be small compared to the component in the process direction 140. Therefore, as shown in FIG. 2, positioning each of wheels 126, 128 that drive the drive ball 122 to be at 45 degrees to the process direction 140 allows the motors 127, 129 to be driven at near constant velocity with small velocity variations required for registration as describe above.

Figure 4:
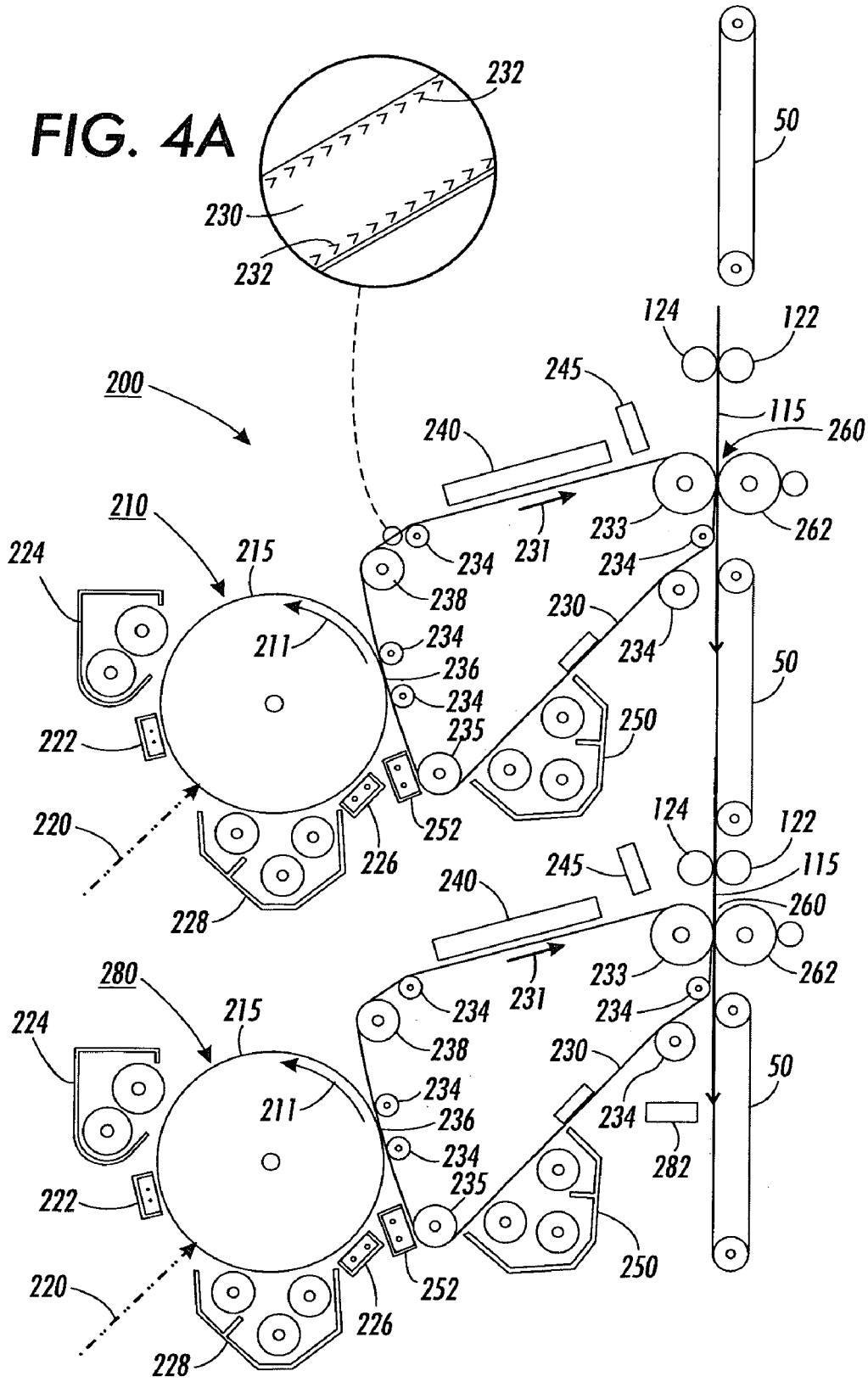

A free sheet color printer 200 improvement over the mechanically coupled printing press type of tandem printer of FIG. 1 is shown in FIG. 4 and includes tandem CEP individual sheet receiving mechanically decoupled engines that obviate the drawbacks of FIG. 1 machines. This improvement is made possible by introducing a registration step before each free sheet reaches each one of a series of tandem print engines. The first of a series of tandem CEP print engines 210 comprises an image receiving member in the form of a photoconductive drum 215 that is adapted to rotate in the direction of arrow 211. Photoconductive drum 215 is charged at 222 and imaged at 220 with a suitable conventional imaging device. Continued rotation of the drum drives it past development station 228 where the image on the drum is developed. The image on drum 215 is charged again at 226 in preparation for transfer to intermediate belt 230. Intermediate belt 230 moves in the direction of arrow 231 to advance successive portions thereof sequentially through the various processing stations disposed about the path of movement thereof. Intermediate belt 230 is entrained about stripping roller 233, tensioning roller 238, idler rollers 234 and drive roller 235. Stripping roller 233 and its adjacent idler roller are mounted rotatably so as to rotate with belt 230. Tensioning roller 238 is resiliently urged against belt 230 to maintain the belt 230 under the desired tension. Drive roller 235 is rotated by a motor coupled thereto by suitable means, such as, a belt drive. As drive roller 235 rotates, it advances belt 230 in the direction of arrow 231.

Intermediate belt 230 is charged at 252 in preparation to receive images thereon from photoconductive drum 215 at station 236. Once an image is placed onto belt 230, continued rotation of the belt takes the image past a conditioner 240 and then past two marks-on-belt (MOB) sensors 245 en route to transfix station 260. The sensors 245 sense marks 232 on belt 230 shown in FIG. 4A to measure the time of arrival of sheet 121 at the transfix station. As a sheet enters the SNIPS pair(s), the servo uses information from sensors 132 and 134 to control its position an angle so that its leading edge will engage the transfix nip 260 at the precise time and with reasonable match to the velocity of the image carrying belt. When the image enters transfix station 90, heated pressure roller 52 compresses the image against sheet 121 where it is simultaneously transferred and fused to the sheet. Continued rotation of belt 230 takes it past a cleaning station 250 where the surface of belt 230 is then cleaned of residual developing material and recharged at station 252 in preparation for receiving another image at station 236. Sheet 115 in the meantime is conveyed by vacuum transport 50 to a second print engine 280 that is equipped and operates exactly as print engine 210 with the exception that print engine 280 is loaded with a different color toner than print engine 210. For example, the charged surface of belt 230 in print engine 210 is imaged at 220, which represents a first color that could be cyan. The resultant latent image is developed with cyan toner particles to produce a cyan image that is subsequently transferred to a sheet 115. The foregoing process is then be repeated for a second color, say magenta with print engine 280, then a third color, say yellow, a fourth color, say black, and one could stop there or include as many print engines and colors as desired in order to expand the color gamut and/or include custom colors. Each color toner image is transferred to the sheet 115 in superimposed registration to produce the desired composite toner image on the sheet.

In the process direction, point or dash sensors are spaced in strategically chosen locations. They measure the time of arrival of the sheet in these locations. The measured time of arrival is compared to the desired time of arrival and a process direction hitch is executed to position the sheet in the process direction to meet intermediate belt 230 at a target time. At all stations, a series of dash sensors are used to measure the time of arrival of the trail edge of the sheet. This information is used to register the image to be imprinted on the second side of the sheet if the printer is used in duplex mode.

As the sheet is delivered to print engines subsequent to the first one, color-to-color registration errors are determined by two MOB sensors 282. Skew errors (rotation about an axis normal to the sheet), and errors related to separation size are corrected within the sheet positioning subsystem. Other registration errors are corrected within the sheet positioning subsystem.

Figure 5:
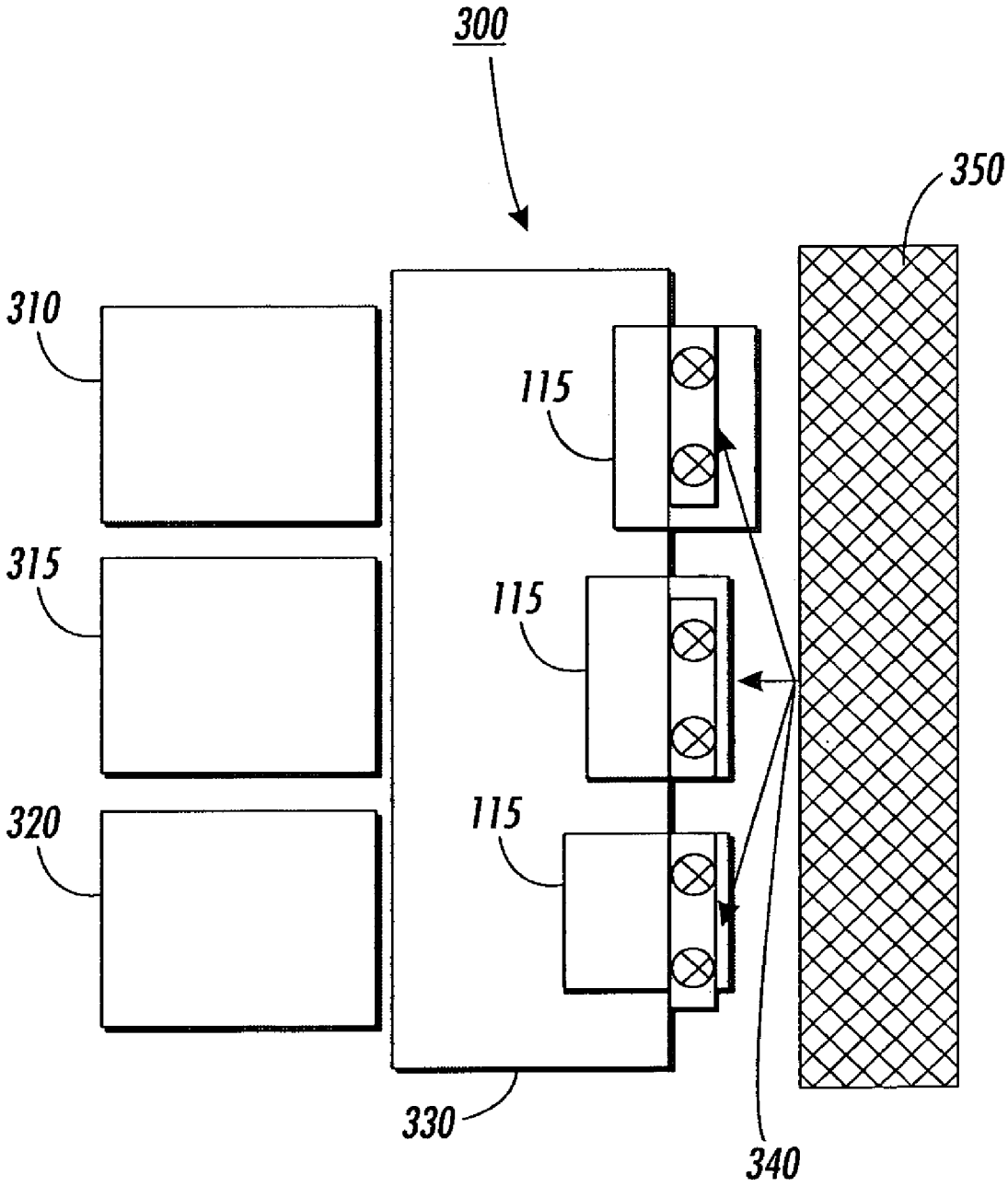
FIG. 5 is a schematic plan view of an extra wide digital output terminal receiving free-sheet parallel input with registration controlled with the use of SNIPS.

If the digital input terminals of FIG. 4 are wide enough, the independence of multiple sheet positioning system 300 as shown in FIG. 5 could be used to allow printing two or more (same or different) sheets 115 side by side whenever so desired. In FIG. 5, sheet feeders 310, 315 and 320 feed individual sheets onto vacuum transport 330. Vacuum transport 330 conveys the sheets into servo driven SNIPS. As each sheet enters the SNIPS pairs 340, the servo control uses information from sensors, such as, 132 and 134 to control its position and angle so that its leading edge will engage the transfix nip at a precise time in order to match the velocity of the development belt. The SNIPS system uses continuous feedback information at least in the lateral direction. If the distance between the SNIPS pairs and the transfix nip 350 is too large, additional sensors could be employed. This free sheet tandem with parallel input provides a variety of different choices that may be made in the type and number of sheets that might printed sequentially or simultaneously.

Registering each sheet before it reaches a transfix nip or the transfer and fusing step in a tandem engine system as disclosed hereinbefore can be used with any imaging system. For example, contact electrostatic printing on belt with ionography, liquid ink development on belt with ionography, contact printing on drum with ionography; contact electrostatic printing with ionography and belt development; powder on belt with photoreceptor and intermediate to enable transfix; powder on belt with ionography or simultaneous duplex.

It should now be understood that an improvement has been disclosed for a tandem printer system that includes free sheet tandem color digital output terminal architectures that register each sheet before it reaches a transfix station of multiple engines. This obviates interactions between imagers, and enables greater flexibility in productivity and machine configurations.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A free sheet tandem color printing system, comprising:

multiple print engines having a predetermined paper path;

a transfix station included within each of said multiple print engines; and multiple registration systems with one of said multiple registration systems positioned immediately adjacent to and upstream of each of said transfix stations and adapted to position the leading edge of each sheet transported within said predetermined paper path to engage a nip at said transfix station at a precise time.

2. The free sheet tandem color printing system of claim 1, wherein said registration system includes a control system that uses information from at least one sensor to position and angle said leading edge of each sheet to engage said nip at said transfix station.

3. The free sheet tandem color printing system of claim 2, including at least two marks-on-belt sensors used to determine color to color registration errors.

4. A free sheet, high-speed, tandem color printing arrangement, comprising:

a sheet transport for feeding sheets within a predetermined paper path;

at least four print engines with each of said at least four print engines adapted to print one of cyan, magenta, yellow and black images on each sheet fed by said sheet transport, and wherein each of said at least four print engines includes a fusing station for fusing said images printed onto the sheets; and multiple registration systems with one of said multiple registration systems positioned immediately adjacent to and upstream of each of said fusing stations and adapted to position the leading edge of each sheet transported within said predetermined paper path to engage a nip at said fusing station at a precise time.

5. The free sheet, high-speed, tandem color printing arrangement of claim 4, wherein said registration system includes a control system that uses information from at least one sensor to position and angle said leading edge of each sheet to engage said nip at said transfix station.

6. The free sheet, high-speed, tandem color printing arrangement of claim 5, including at least two marks-on-belt sensors used to determine color to color registration errors.

7. The free sheet, high-speed, tandem color printing arrangement of claim 4, including multiple parallel sheet inputs to said sheet transport.

8. A free sheet tandem color printing method, comprising:

providing multiple print engines having a predetermined paper path;

providing a transfix station within each of said multiple print engines; and providing multiple registration systems with one of said multiple registration systems positioned immediately adjacent to and upstream of each of said transfix stations adapted to position the leading edge of each sheet transported within said predetermined paper path to engage a nip at said transfix station at a precise time.

9. The free sheet tandem color printing method of claim 8, including the step of providing said registration system with a control system that uses information from at least one sensor to position and angle said leading edge of each sheet to engage said nip at said transfix station.

10. The free sheet tandem color printing method of claim 9, including the step of using at least two marks-on-belt sensors to determine color to color registration errors.

* * * * *